United States Patent [19]

Dittmann et al.

[11] 4,193,658

[45] Mar. 18, 1980

[54] MODULAR TELEPHONE PLUG

[75] Inventors: Larry E. Dittmann; Robert M. Koch, both of Harrisburg; Van K. Webster, Camp Hill; Edwin T. Harris, Middletown, all of Pa.

[73] Assignee: AMP Incorporated, Harrisburg, Pa.

[21] Appl. No.: 900,468

[22] Filed: Apr. 27, 1978

[51] Int. Cl.[2] ..... H01R 13/38

[52] U.S. Cl. ..... 339/97 P

[58] Field of Search ..... 339/97 R, 97 P, 98, 339/99 R

[56] References Cited

U.S. PATENT DOCUMENTS

| | | | |
|---|---|---|---|
| 2,964,171 | 12/1960 | Chadwick | 339/276 SF |
| 3,355,699 | 11/1967 | Oshva | 339/99 R |
| 4,047,784 | 9/1977 | Trank | 339/98 |

*Primary Examiner*—Joseph H. McGlynn
*Attorney, Agent, or Firm*—Allan B. Osborne

[57] ABSTRACT

The present invention relates to a plug and its method of manufacture. The plug is of the type having a two piece, insulative housing and flat-bladed terminals. More particularly, the method of manufacture includes a continuous molding operation wherein a plurality of cavities are spaced about the circumference of a wheel.

1 Claim, 15 Drawing Figures

10
12
14
16
18
20
22
24
26
28
30
32
34
36
38
40
42
44
46
48
50
52
54
58
60
62
64
72
74
76
78
90
96
98
100
102
104
106
108
110
112
114
116
118
120
122
124
128
130

MODULAR TELEPHONE PLUG

BACKGROUND OF THE INVENTION

1. Field of the Invention

This invention relates to molded thermoplastic articles in continuous strip form and to methods and apparatus for molding such articles.

2. The Prior Art

A representative selection of the prior art includes U.S. Pat. Nos. 2,282,303; 3,752,619; 3,833,329 and 3,873,257, all of which disclose methods and apparatus for continuous molding. The apparatus disclosed is a rotating wheel having a plurality of movable molding elements thereon and a stationary device for extruding molten material into cavities in the molding elements.

THE PRESENT INVENTION

The present invention discloses a modular plug for use in telephone sets and a method of making which includes the continuous molding thereof on a rotating wheel. Subsequent to the step of receiving the molten thermoplastic material, the molding assemblies pass a cooling water stream and are then taken off the wheel on a continuous strip.

BRIEF DESCRIPTION OF THE DRAWINGS

FIG. 3 illustrates the stamped and formed terminals;

DESCRIPTION OF THE INVENTION

Description of the Product

Figure 1:
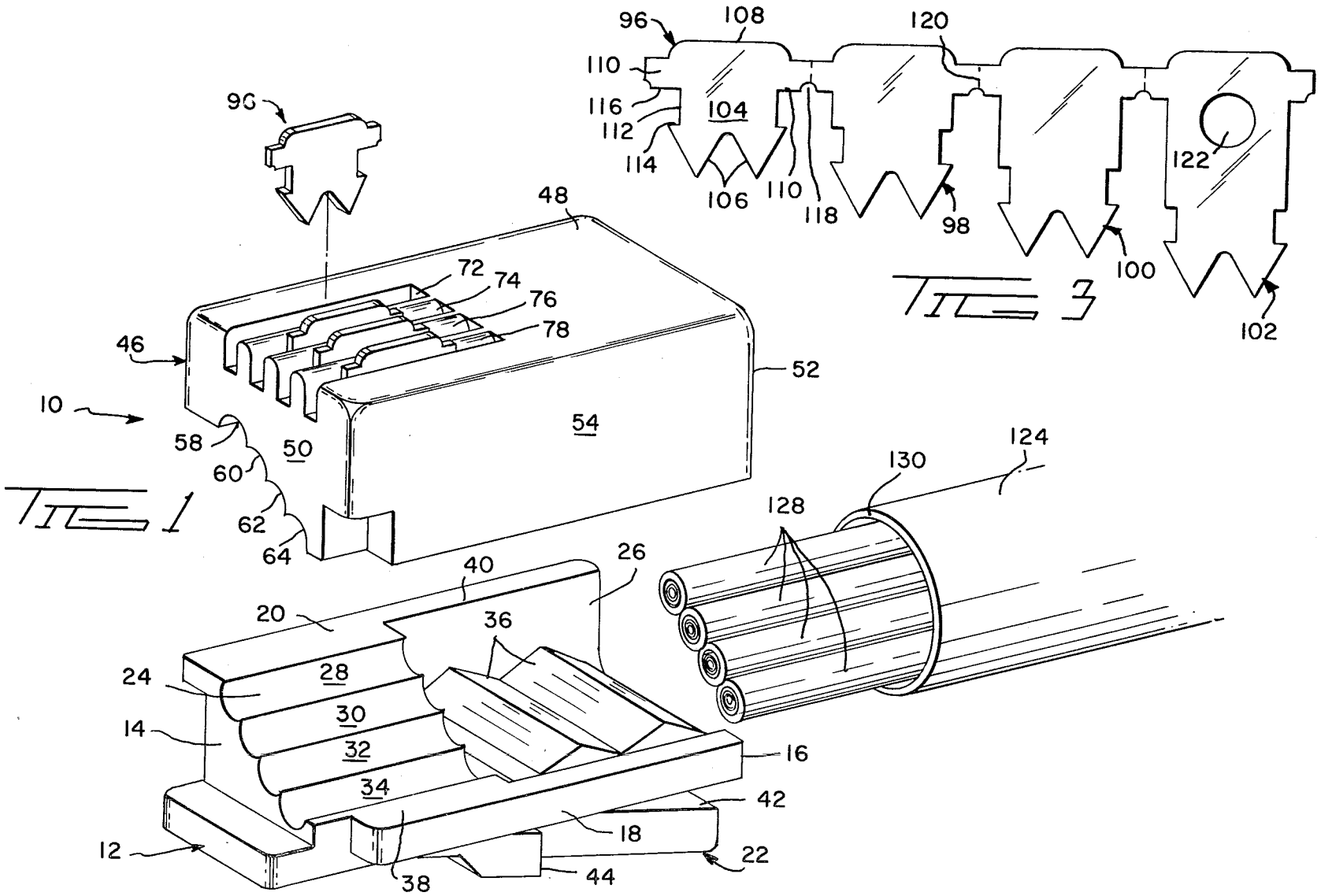
FIG. 1 is an exploded view of the modular plug molded on a continuous strip.

FIG. 1 shows in perspective the two piece housing 10 which with the terminals shown in FIG. 3 comprise the modular plug of the present invention. The preferred material used in the molding process is polycarbonate. Other like insulative materials may also be equally satisfactory provided they have suitably mechanical strength, adequate electrical insulation and preferably are susceptible to ultrasonic welding.

Base 12 of plug 10 is axially elongated and has front face 14, rear face 16, floor 18, a side wall 20 and locking latch 22 depending obliquely from floor 18.

The upper surface of floor 18 is divided into two sections, front section 24 and rear section 26. The front section has four arcuate grooves 28, 30, 32 and 34 on the inclined surface of the section. Preferably the angle of inclination is about 39 degrees relative to the horizontal plane. Section 26 includes two elongated teeth 36 extending transversely across floor 18. The teeth preferably do not rise above groove 32. Upwardly facing ledges 38 and 40 extend along the sides of the two sections, the former being coplanar with floor 18 and the latter along top of side wall 20.

Locking latch 22 is integral with floor 18 and has a stem 42 and a pair of rearwardly facing shoulders 44 on either side thereof. The latch permits the retention of the plug in a receptacle in a telephone (not shown). Such latch is shown and described in more detail in U.S. Pat. No. 3,761,869 and is not part of the invention herein.

Cap 46 is very similar to base 12 in general. It has an upper surface 48, front face 50, rear face 52 and side wall 54.

The lower surface of the cap has two sections corresponding to base sections 24 and 26. Front section 56 contains four arcuate grooves 58, 60, 62 and 64 spaced on the inclined surface extending to sidewall 54 from the other side. As shown in FIG. 1, the inclined surfaces of the base and the cap are mirror images. The rear section 66, which can be seen in FIGS. 4 and 5, has a depending tooth 68. Downwardly facing ledges (not shown) corresponding to ledges 38 and 40 on the base are provided on the cap.

The upper surface 48 of cap 46 has four notches 72, 74, 76 and 78 extending rearwardly from front face 50. As is apparent, the location and length of these notches coincide with the grooves 58 through 64.

Figure 2:
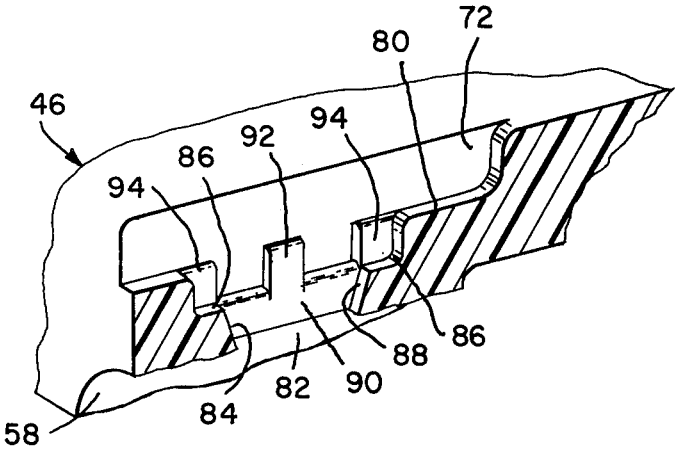
FIG. 2 shows the detail of a terminal-receiving slot in the plug of FIG. 1.
Figure 4:
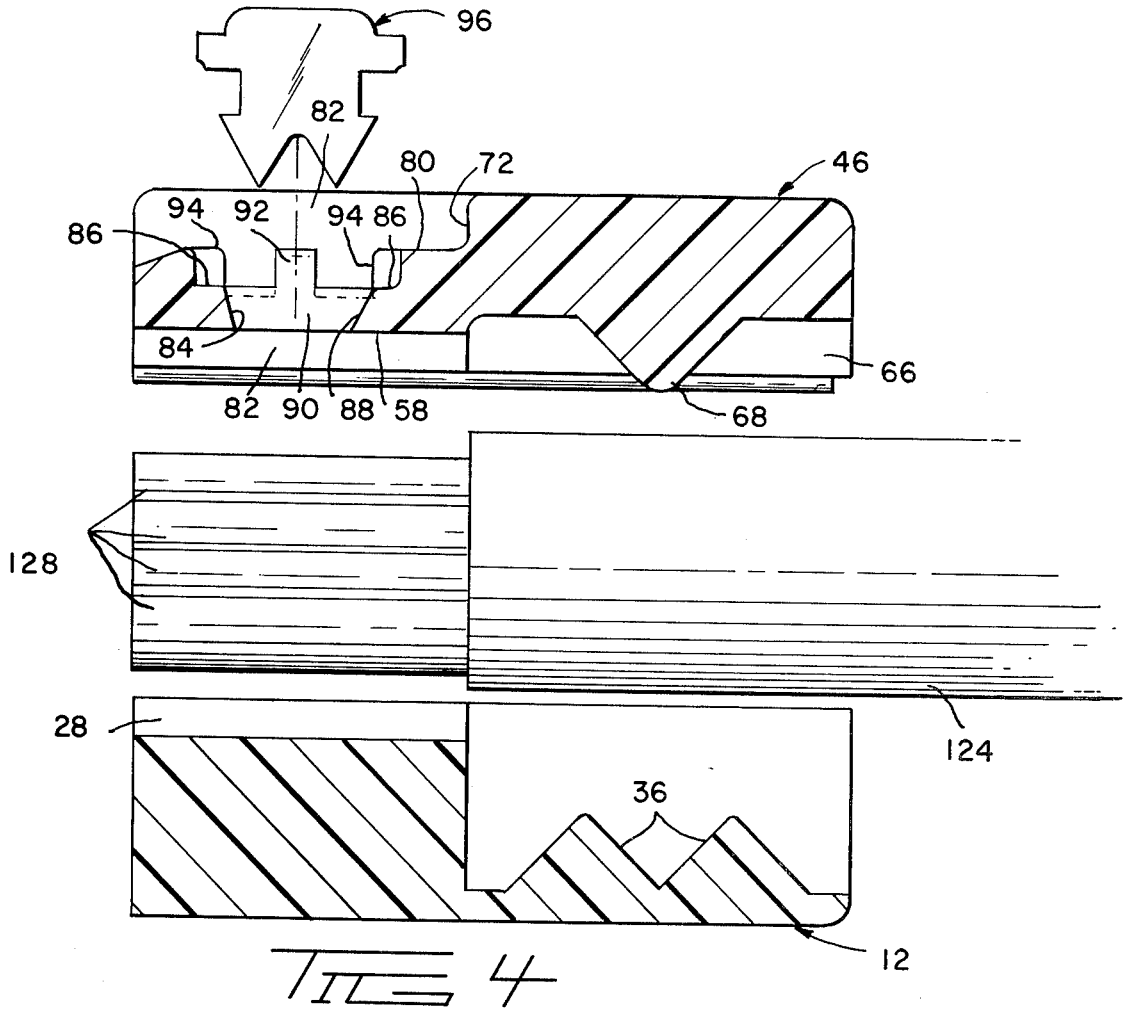
FIGS. 4 and 5 illustrate the termination of a telephone cord in the plug of FIG. 1.

Attention is now directed to FIGS. 2 and 4 which more clearly depict the structure of the aforementioned notches and belowmentioned slots which communicate with the grooves. The floor 80 of each notch contains the opening to slot 82 which intersects the underlying groove. The structure of the slot is such that in the upper section the end walls 84 thereof are vertical for a predetermined distance into the cap material. The span is narrowed at that point to provide two upwardly facing shoulders 86. The lower section of the slot extends from the shoulders down to the underlying groove with the walls beveled inwardly as indicated generally by reference numeral 88.

The side walls 90 of the slot are cut out in two places to define a center abutment 92 and end abutments 94. Preferably the edges along the side walls have been rounded.

The four terminals 96, 98, 100 and 102 are stamped from a coplanar strip of conductive material such as a copper alloy. As seen in FIG. 3, each terminal has a flat portion 104 with a pair of depending insulation-piercing beveled or arrow-shaped contacts or tangs 106. The tangs are preferably slightly wider than the beveled portion of the slots. The upper end of the terminals are curved crowns 108. Each terminal is formed with ears 110 and necked down sections 112 therebelow which terminate in barbs 114. The vertical length of the necked-down portion is the same in each terminal. The increased length in terminals 98–102 is provided by additional material between the ears and the top of the necked down portions.

The ears 110 provide downwardly facing shoulders 116. The free ends of the shoulders are concaved as indicated by reference numeral 118. The vertical length of the ears is the same as the depth of the vertical upper section of slots 82.

As noted above, the terminals are preferably stamped from a strip of flat stock. The dashed lines, indicated by reference numeral 120, show the cut lines between each terminal. The hole 122 seen in end terminal 102 is for centering and guiding the strip through the stamping and forming dies (not shown).

Figure 5:
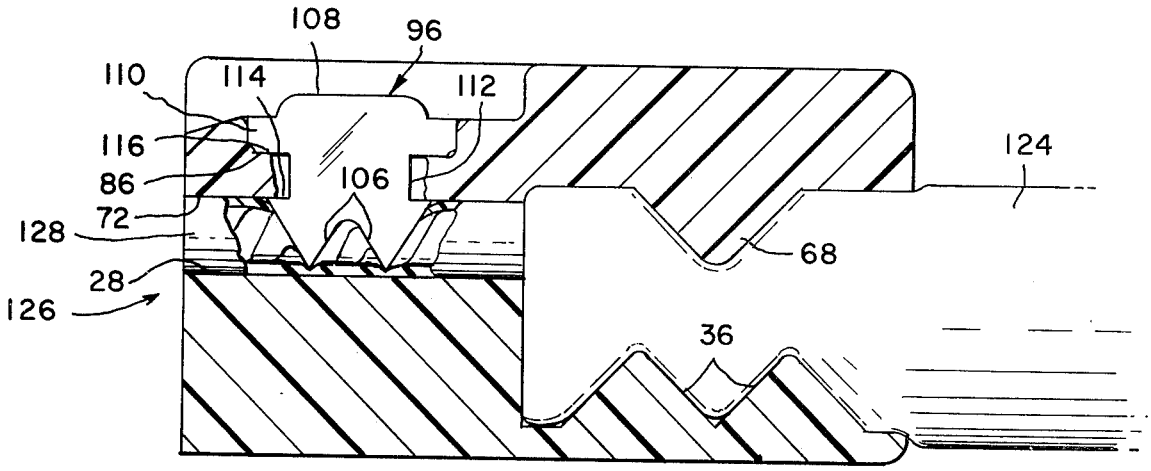

The cord 124 which is terminated in plug 126 carries four separately insulated conductors 128 as seen in FIG. 1. FIGS. 4 and 5 illustrate one method of termination.

After the four terminals 96–102 are cut apart, they are partially inserted (not shown) into their respective slots; i.e., terminal 96, being the shortest, goes into the short slot in notch 72. The longest terminal 102 is placed into the long slot in notch 78. Obviously terminals 98 and 100 go into the slots in notches 74 and 76 respectively.

With the cord's outer jacket 130 removed for a length equal to the length of front section 24 the four insulated conductors are laid into the four grooves 28, 30, 32 and 34 such as is shown in FIG. 4. The cap is then placed down onto the base with grooves 58–64 cooperating with grooves 28–34 to encircle each conductor 128. The cap may be secured to the base by ultra-sonic bonding; the ledges 38, 40, on the base being bonded to their corresponding ledges on the cap. Adhesive may also be used in lieu of ultra-sonic bonding.

Concurrently, or subsequent to the bonding, the terminals are driven further into the slots so that tangs 106 can pierce the insulation and make contact with the underlying conductors (FIG. 5).

As the terminals are being driven down, the arrow-shaped tangs push out and also cut into the beveled end walls of the slots. After the barbs 114 have passed through, the end walls rebound to flow into the necked down sections 112 so as to trap the terminal in the slot against withdrawal forces. The aforementioned downwardly facing shoulders 116 on ears 110 abut against the upwardly facing shoulders 86 in the slot so that crown 108 stands up in the notch a predetermined distance.

The completed assembly is shown in FIG. 5. The teeth 36 and 68 cooperate to hold cord 124 in the plug.

Figure 6:
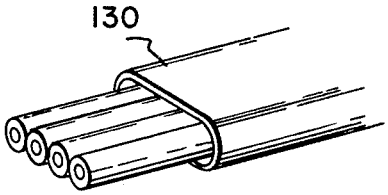
FIG. 6 shows a flat telephone cord.

Cord 128 is known in the telephone industry as a round cord. FIG. 6 illustrates a newer type; a flat cord, designated by reference numeral 130. Aside from the obvious dissimilarity, the major difference between the two cords is in their respective dimensions. The newer flat cord 130 has an overall dimension of 0.090×0.160 inches (2.28×4.06 mm) with each individual conductor being about 0.038 inches (0.96 mm) in diameter. As FIG. 6 shows the conductors are positioned quite symmetrically in the cord. The older round cord 124 is about 0.180 inches (4.57 mm) in diameter; its individual conductors are about 0.050 inches (1.27 mm) in diameter and are randomly positioned within. Accordingly, if the conductors of each cord are laid out flat in parallel fashion, the grooves and slots would have to be on 0.050 inch (1.27 mm) centers for cord 124 and 0.040 inch (1.02 mm) centers for cord 130. Obviously, a plug with horizontal grooves could only accept the cord for which it was precisely designed. One of the novelties of the present invention is that the grooves are inclined. By so doing, the slots can be placed on 0.040 inch (1.02 mm) centers even though the grooves are 0.050 inches (1.27 mm) in diameter. Accordingly, plug 126 is capable of accepting and terminating both the old and new cords.

DESCRIPTION OF THE APPARATUS AND PROCESS OF MAKING MODULAR PLUG 126

Figure 7:
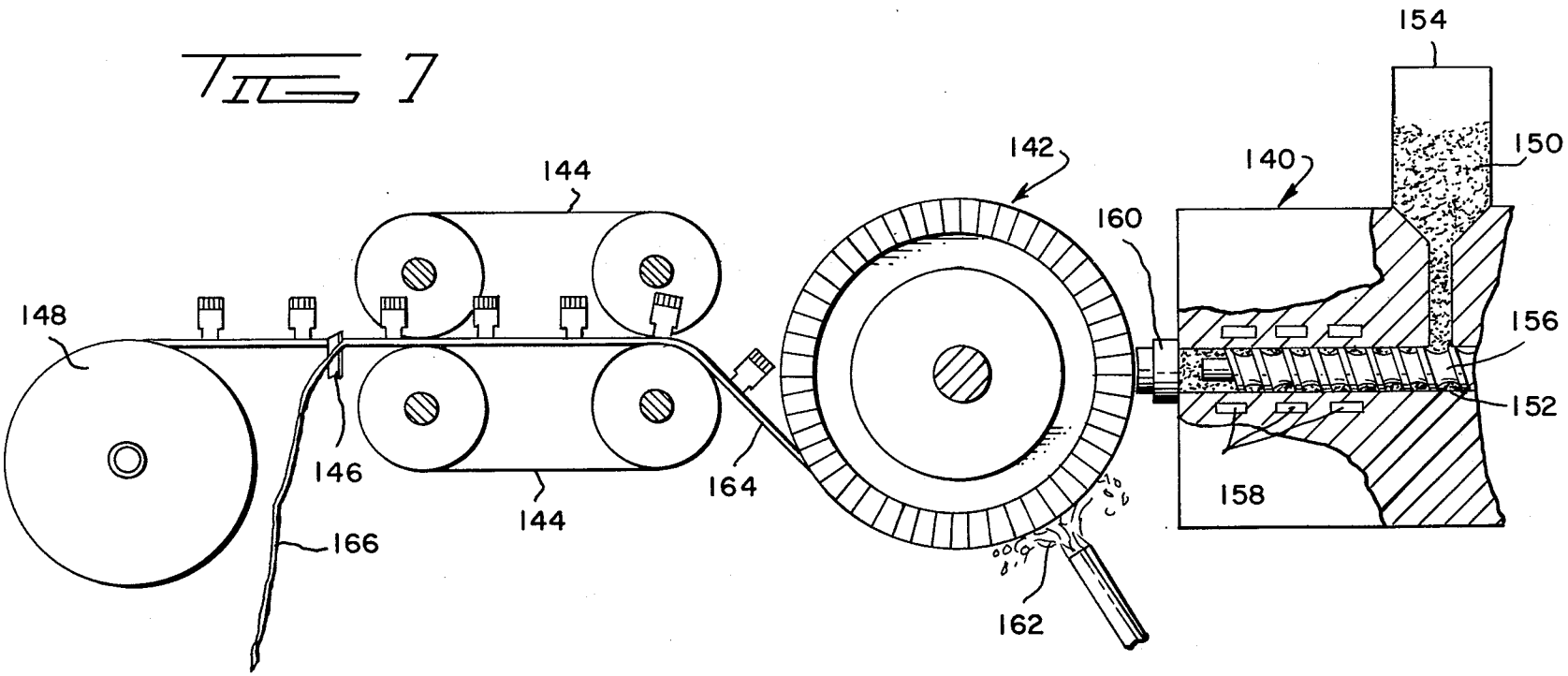
FIG. 7 shows in generalized form the apparatus used in molding the plug of FIG. 1.

FIG. 7 shows generally the apparatus and process for making the plug of the present invention. The equipment includes, from right to left, the injection molding machine 140, continuous rotating molding wheel 142, endless moving belts 144, trimming blades 146 and driven take up reel 148.

Molding powder 150 is fed by gravity to passageway 152 from hopper 154. As the powder moves leftwardly via rotating screw 156, it is softened and rendered flowable by heating units 158. Passageway 152 communicates with a passageway in an extrusion head 160. The fused powder flows to the head from where it is injected through nozzle 161 (FIG. 8) into mold assembly cavities carried by wheel 142 and also on ribs between the mold assemblies. As the wheel rotates past head 160, the molding material is subjected to a cooling water stream 162 to solidify it. The solidified strip 164 is removed from the molding wheel by belts 144. As the strip is pulled leftwardly by driven reel 148, it passes trimming blade 146 which trims excess material 166 from the sides. The trimmed strip is then wound up onto reel 148.

Figure 8:
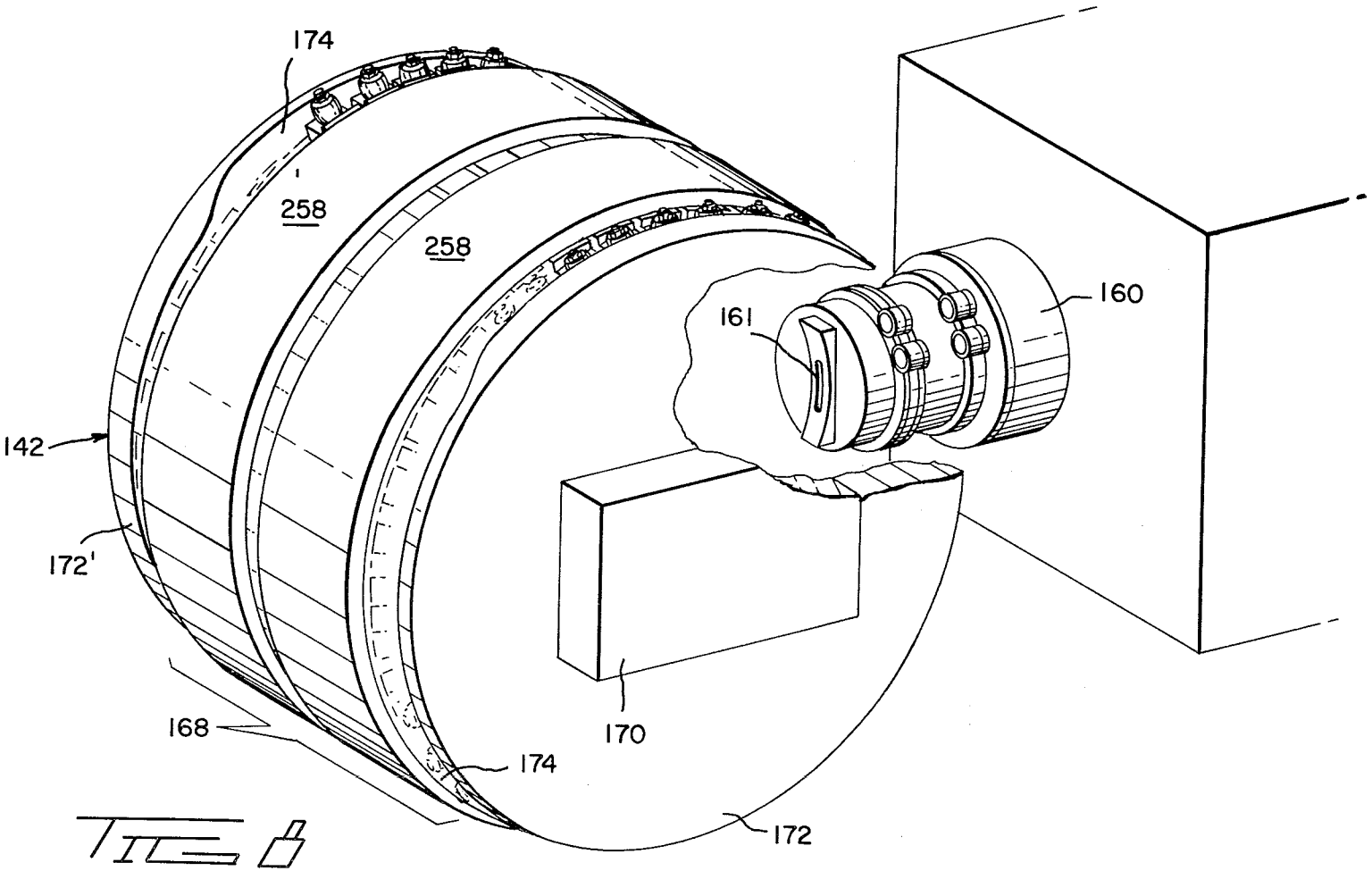
FIG. 8 shows additional details of the molding wheel and extrusion head comprising some of the apparatus of FIG. 7.

Turning now to FIG. 8, the general aspects of molding wheel 142 will be pointed out. The wheel has a rotating portion indicated generally by reference numeral 168. Portion 168 is keyed or otherwise secured to a shaft mounted in bearings in housings 170, positioned on either side of the wheel. The rotating portion is rotated by means of a motor (not shown) coupled directly to the shaft through a gear box (not shown).

Stationary camming rings 172–172' are mounted and supported on housings 170. These two rings bracket rotating section 168. Each ring contains an outwardly opening cam track 174 extending completely around the circumference. These tracks define a non-linear path which will be discussed in connection with the operation of the molding apparatus.

The assembly comprising the camming rings and rotating section are adjustably mounted with respect to extrusion nozzle 161 so that it can be moved by small increments towards and away from the face of the nozzle. Thus, precise adjustment of the gap between the nozzle and surface of the molding wheel can be made to enable accurate control of the molding process.

The specific details relative to the molding of cap 46 of plug 10 will now be described with reference to FIGS. 9 and 10.

The rotating portion comprises two bolted-together sections 176 and 178 which have respectively, transversely extending recesses 184 and 186 spaced about the circumference of the sections. These recesses open into one another. Mold sub-assembly 188 is positioned in recess 184 and mold sub-assembly 190 is positioned in recess 186. Ribs 191 define and separate the recesses. The two sub-assemblies comprise the cap mold assembly.

Figure 9:
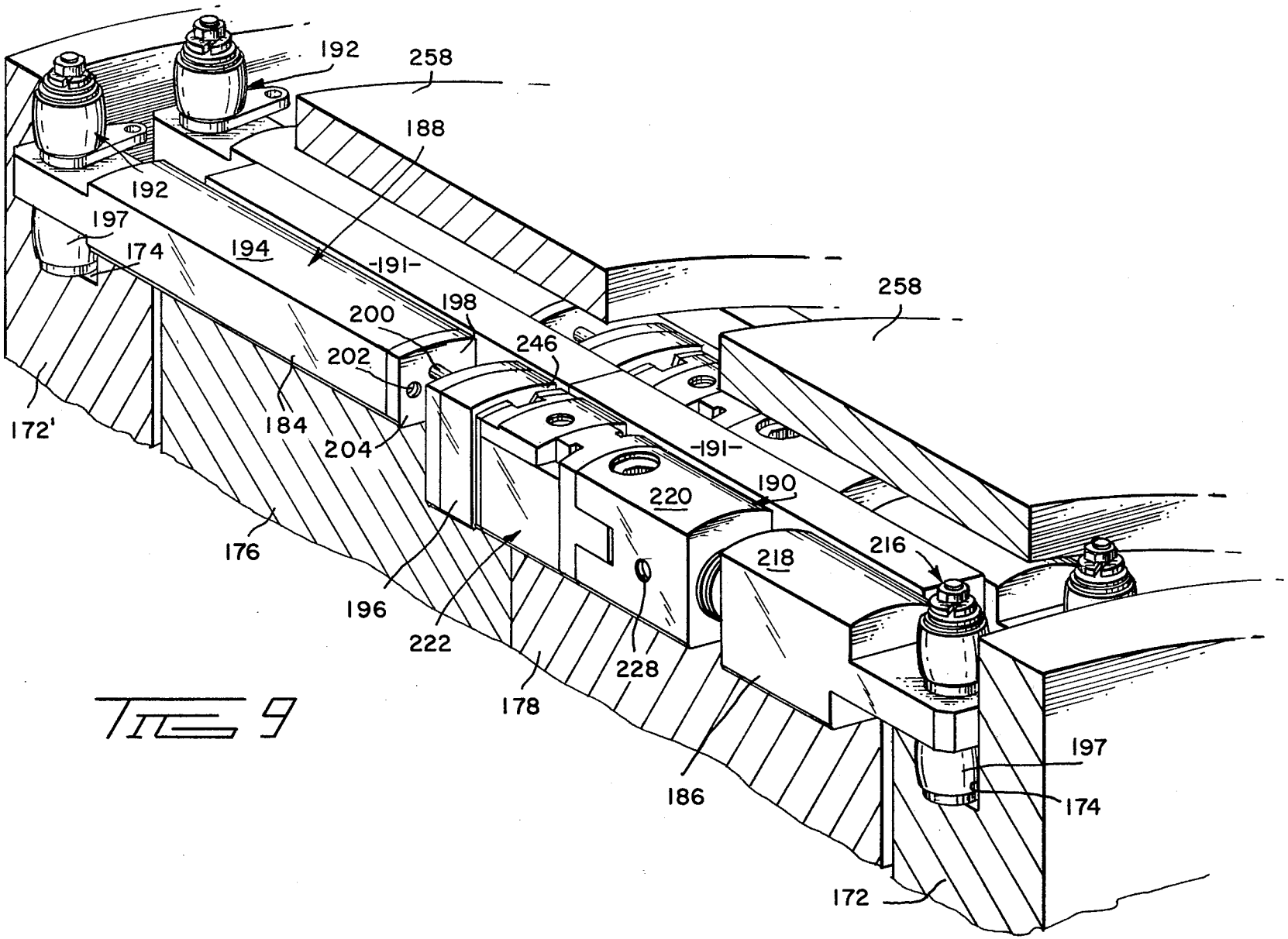
FIG. 9 shows a set of mold sub-assemblies and cam means for imparting transverse or lateral movement thereto.

Mold sub-assembly 188, which is to the left in FIG. 9, has a cam follower 192, an ejector slide 194 and a fixed mold section 196. The cam follower is mounted in eccentric bushings 197 to permit fine adjustment of assembly travel.

The ejector slide is secured to the cam follower at its outer end. As seen in FIG. 10, its inner end 198 consists of a center ejector pin 200, two smaller ejector pins 202 (only one shown) and a pin retainer plate 204. The two pins 202 are positioned on either side and slightly below the center pin 200.

Figure 10:
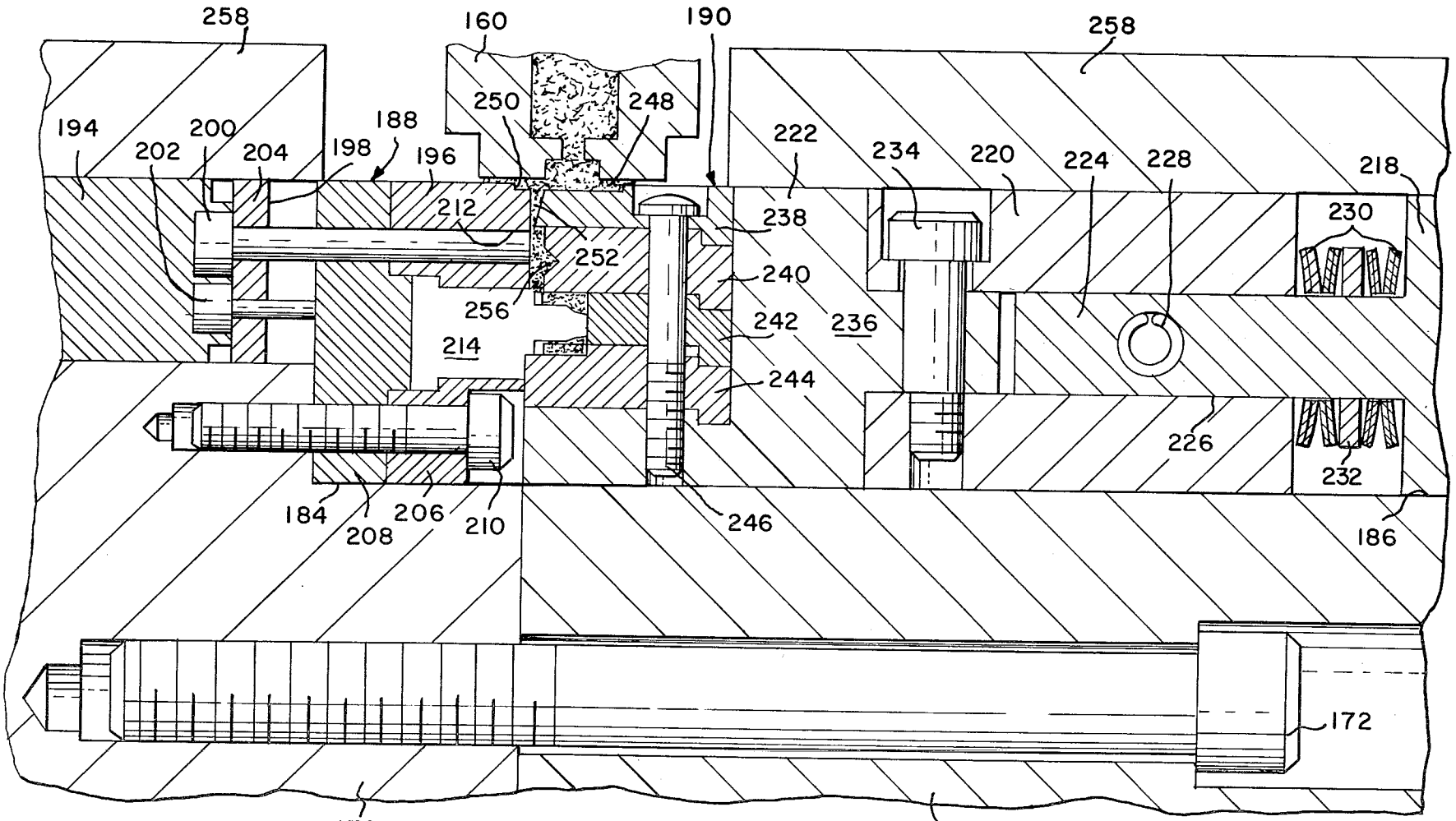
FIG. 10 shows the details of the mold sub-assembly for molding the cap of the plug in FIG. 1.

As seen in FIG. 10, the fixed mold section 196 consists of front and rear blocks 206 and 208 respectively, held together and to section 176 by machine screw 210. Both blocks have three aligned passages 212 (of which only one is shown) to receive ejector pins 200 and 202. The front block contains four, spaced core pins 214, only one of which can be seen. The core pins decrease in length to provide the notches and slots in the cap.

With reference to both FIGS. 9 and 10, mold sub-assembly 190, which is to the right, has three parts: a cam follower 216, an outer slide 218, a inner slide 220 and a cap cavity group 222. The cam follower is mounted on an eccentric bushing 197.

The outer slide 218 is connected at its outer end to cam follower 216 and to the inner slide 220 at its inner end. A longitudinal shaft 224, seen in FIG. 10, on the outer slide's inner end is received in a passage 226 in the outer end of the inner slide 220. A pin 228 holds the shaft loosely in the passage. A pair of belleville spring washers 230, positioned on the shaft, bias the outer and inner slides apart. Spring spacer 232 separates the two washers.

The cavity group 222 is connected to inner slide 220 by bolt 234. As seen in FIG. 10, the group comprises an L-shaped block 236 and cavity plates 238 through 244. The plates are held to block 236 by screw 246. As the drawing shows, the plates are on the inner end of mold sub-assembly 190 and define in combination cap 46 of the plug.

The top surface of plate 238 has a recess 248 which is on the same level as a like recess 250 in the front block 206. The plate's front face is beveled as shown generally by reference numeral 252.

The front face of plate 240 ends short of face 252 and contains a triangular recess 256.

Plate 242 is recessed diagonally so as to accommodate the four core pins 214. The face is also grooved (not shown) to provide grooves 58–64 on the cap.

Plate 244 abuts the face of the opposing fixed mold section 196.

A pair of retaining bands 258 encircle and cover most of the two mold sub-assemblies 188 and 190 to retain them in the recesses. As FIG. 10 shows, the fixed mold section 196 and the mold cavity plate subassembly (plates 238 etc.) are exposed.

In operation, flowable molding powder 150 is extruded through extrusion head 160 into the mold cavities as the wheel rotates. Besides flowing into the cavities, the powder fills recesses 248 and 250 and further, as the wheel moves past the extrusion head, powder flows across the ribs 191 to provide a connecting strip from one molded piece to the next.

As the wheel rotates past the nozzle towards and beyond cooling water stream 162, cam follower 216, riding in cam track 174, pulls mold sub-assembly 190 to the right. Simultaneously mold sub-assembly 188 except for the fixed mold section 196 is being moved to the right by its cam follower riding in its cam track 174. The ejector pins 200 and 202, moving out of passage 212, push the molded cap 46 off core pins 214 and thus free the molded cap from the mold assembly. As the wheel rotates on around, the mold sub-assemblies 188 and 190 are pulled back to the left into the position shown in FIGS. 9 and 10.

Figure 11:
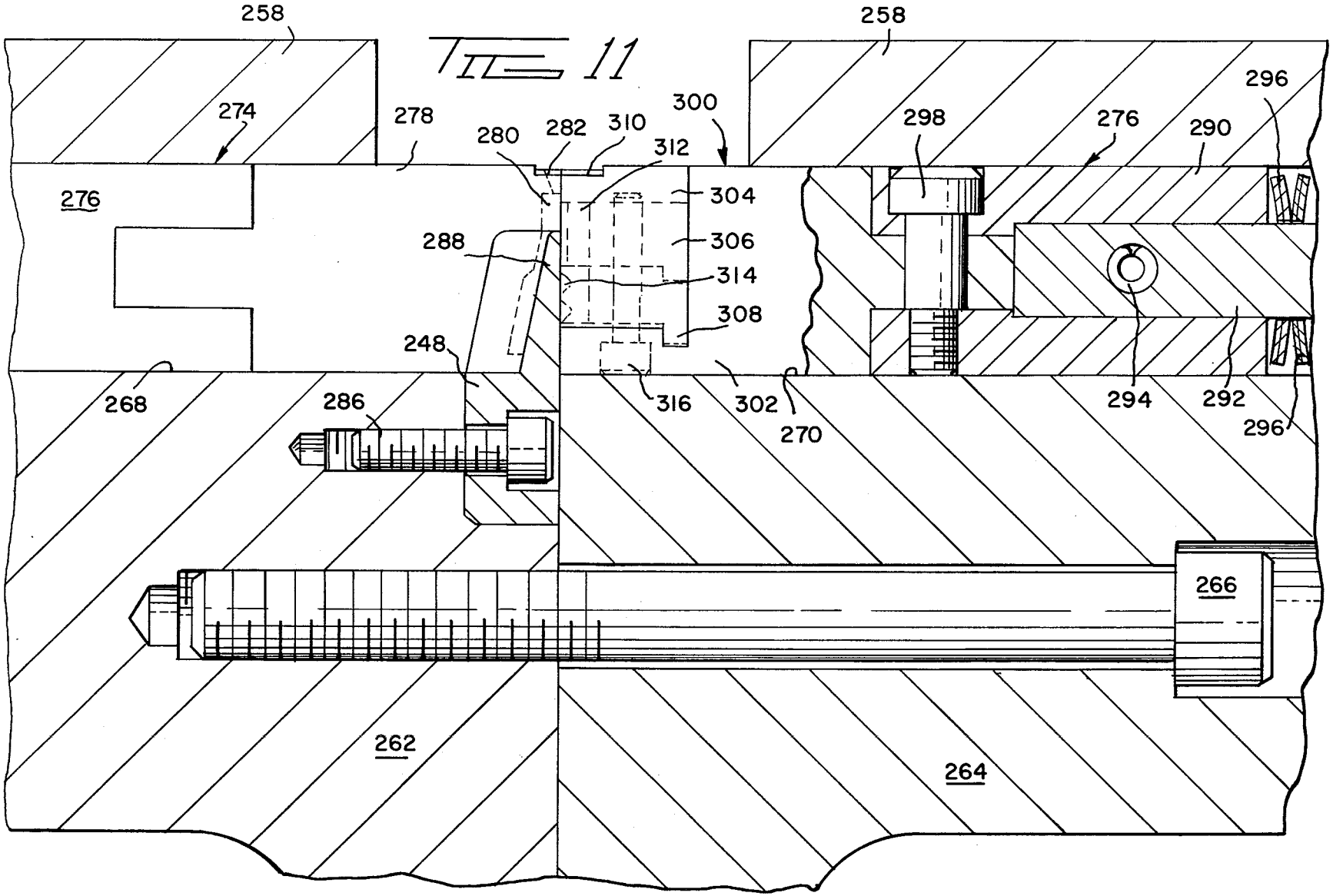
FIG. 11 shows the details of the mold sub-assembly for molding the base of the plug of FIG. 1.

FIG. 11 shows the inner ends of the mold sub-assemblies used for making base 12 of plug 126. As can be appreciated, much of the equipment described above with respect to making cap 46 is identical or very similar to that for making the base.

The rotation portion comprises sections 262 and 264, joined together by bolt 266, have recesses 268 and 270 respectively spaced around their circumference. Ribs 191 (not shown) define the recesses. Left and right mold sub-assemblies 274 and 276 occupy recesses 268 and 270 respectively. The two sub-assemblies comprise the base mold assembly.

In addition to a cam follower, (not shown) mold sub-assembly 274 has a outer slide 276 connected to the cam follower in the same manner as the outer slide 220 is connected to cam follower 218; i.e., by a loosely pinned shaft and belleville washers. At the inner end of sub-assembly 274 cavity section 278 is secured to the outer slide 276. The face of this section contains cavity 280, shown in dashed lines, which is in the shape of the bottom of plug base 12 and locking latch 22. The upper corner of the section contains notch 282.

A core insert 284, fixed by bolt 286 to section 262, provides core pin 288 extending vertically upwardly into cavity 280.

Mold sub-assembly 276 includes a cam follower (not shown) which is connected to outer slide 290 via shaft 292 and pin 294. Belleville washers 296 (only one shown) bias the cam follower and slide 290 apart. As in the other mold sub-assemblies, the pin is loosely fitted.

Attached to the outer slide 290 by bolt 298 is base cavity group 300. This group includes block 302 and cavity plates 304, 306 and 308.

Plate 304 has a notch 310 at its upper left hand corner. The face 312 of underlying block 306 is recessed to reflect front section 24 of the plug base (FIG. 1); i.e., an inclined surface with four distinct arcuate ribs (not shown). Recessed face 314 of the lowermost block 308 reflects the base's rear section 26.

Bolt 316 holds the three plates in position.

In operation the base molding assembly functions in much the same manner as with the cap molding assembly described above.

The inner ends of the two mold sub-assemblies 274 and 276 are in abutting relation as they pass the extrusion head and cooling water stream. Thereafter both assemblies are pulled outwardly; i.e., away from each other, to open the mold. After the molded base is pulled from the wheel, the sub-assemblies are returned to their abutting position.

Figure 12B:
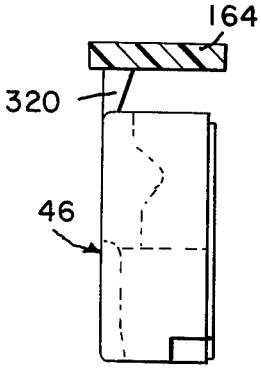
FIGS. 12*a*, 12*b*, 13*a* and 13*b* illustrate the two halves of the plug as they come off the molding wheel in a continuous strip.
Figure 12A:
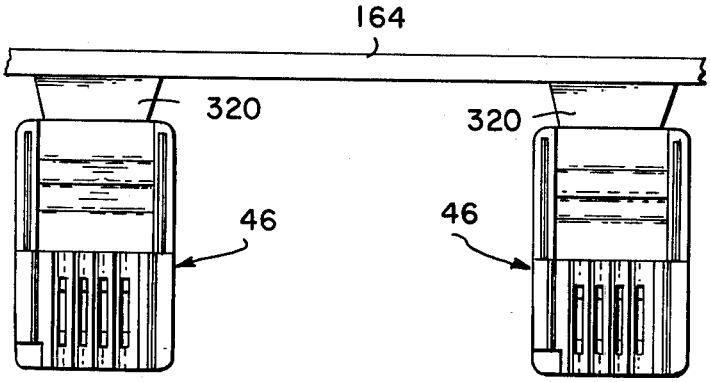

FIG. 12*a* illustrates a length of strip 164 with caps 46 attached thereto by strap 320. FIG. 12*b* is a view looking at the strip from an end.

Figure 13B:
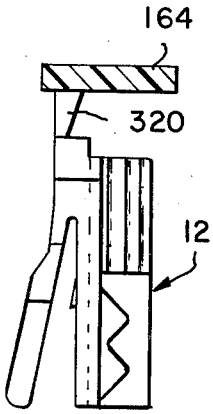
Figure 13A:
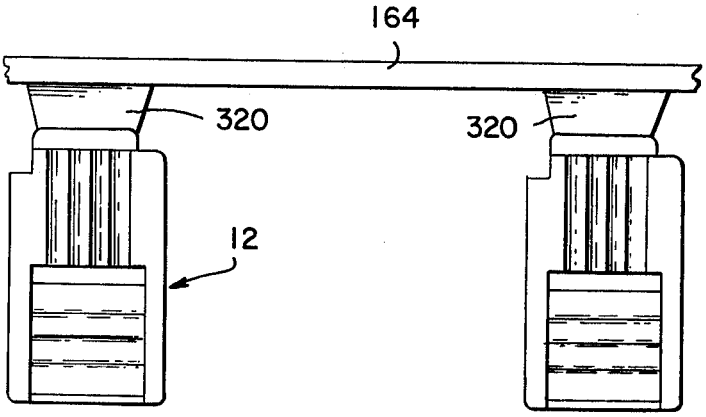

FIGS. 13*a* and 13*b* are the same as FIGS. 12*a* and 12*b* except the showing of the base 12 of the plug.

The foregoing detailed description has been given for clearness of understanding only, and no unnecessary limitations should be understood therefrom, as some modifications will be obvious to those skilled in the art.

What is claimed is:

1. A modular telephone plug formed from two separate components, comprising:

a. a first component, molded from an insulating material, being generally rectangular with one side wall being longer than the opposite side wall, thereby providing an inclined surface, said inclined surface having a plurality of longitudinally extending grooves thereon, and a plurality of slots extending from the grooves to the surface opposite said inclined surface, said slots being adapted to receive insulated wire-piercing terminals therein; and b. a second component, molded from an insulating material, being generally rectangular with one side wall being longer than the opposite side wall, thereby providing an inclined surface, said inclined surface having a plurality of longitudinally extending grooves thereon, said first and second components being oriented so that upon bonding the two together to form said plug, the inclined surfaces are conformably mated with the respective grooves forming circular passageways adapted to contain telephone wires therein for termination by inserting insulated wire piercing terminals through said slots.

* * * * *